US006508194B2

(12) United States Patent
Myers

(10) Patent No.: US 6,508,194 B2
(45) Date of Patent: Jan. 21, 2003

(54) PONTOON WATERCRAFT

(76) Inventor: Robert J. Myers, 2701 E. Hammer La. Suite 110, Stockton, CA (US) 95210

( * ) Notice: Subject to any disclaimer, the term of this patent is extended or adjusted under 35 U.S.C. 154(b) by 0 days.

(21) Appl. No.: 10/145,346

(22) Filed: May 13, 2002

(65) Prior Publication Data

US 2002/0129756 A1 Sep. 19, 2002

Related U.S. Application Data

(63) Continuation-in-part of application No. 10/072,495, filed on Feb. 4, 2002, now abandoned, which is a continuation-in-part of application No. 09/660,997, filed on Sep. 13, 2000, now Pat. No. 6,343,560.

(51) Int. Cl.[7] ..... B63B 1/00
(52) U.S. Cl. ..... 114/354; 114/61.25
(58) Field of Search ..... 114/61.1, 61.24, 114/61.25, 363, 345, 352–354; 441/35, 40, 43, 129, 130

(56) References Cited

U.S. PATENT DOCUMENTS 2,747,204 A * 5/1956 Erickson et al. ..... 114/363
4,854,257 A * 8/1989 Grayson ..... 114/61
6,311,632 B1 * 11/2001 Noel, Jr. ..... 114/61.1

* cited by examiner

*Primary Examiner*—Ed Swinehart
(74) *Attorney, Agent, or Firm*—Milburn & Peterson, P.C.; Robert C. Peterson

(57) ABSTRACT

A personal pontoon watercraft having a pair of pontoons with twin bladders secured by a three piece yoke frame which maintain the pontoons spaced apart and symmetrical and parallel with each other to accommodate the user, with an integrated load leveling system for personal and operational convenience. The watercraft is adapted to support an adjustable motor and anchor mount behind the user and two piece oars in gunwales at the outermost part of the yoke frame. The design provides for other auxiliary items such as a mesh fish basket, storage containers and the like. Further, the watercraft is assembled with no special tools and when disassembled the entire watercraft can be stored in a suitable bag having a length of approximately four feet and a girth of approximately six to seven feet. In addition, two pontoon watercrafts are coupled in tandem with the fore ends of the pontoons of one watercraft nestled with the aft ends of the pontoons of another watercraft with a lattice work coupling the frame of the two watercrafts, which form a composite watercraft. The watercrafts are adapted to support stand-up apparatus.

20 Claims, 13 Drawing Sheets

PONTOON WATERCRAFT

This is a Continuation-in-Part of patent application, Ser. No. 10/072,495, filed Feb. 4, 2002, which is a Continuation-in-part of patent application, Ser. No. 09/660,997, filed Sep. 13, 2000, now U.S. Pat. No. 6,343,560 B1.

BACKGROUND OF THE INVENTION

1. Field

This invention relates to an individual watercraft. More specifically, the invention is directed to inflatable pontoon watercraft, and provides several enhancements for such boats.

2. State of the Art

Typically, boats or watercrafts designed for individuals are powered by the action of swim fins on the user's feet or of oars supported on the framework of the watercraft. Small motors may also be used on these boats. Such boats are popularly used as fishing platforms, but they are also used more generally for water transport, such as in connection with hunting, touring or white water rafting.

These watercraft generally comprise two inflatable cylindrical pontoons harnessed together by means of a rigid mainframe. The mainframe functions as the support for seating or decking, and also serves as the attachment point for any optional equipment; such as foot rests, frame extensions, motors, oars, rod holders, beverage holders, fish finders, stripping aprons, cargo containers, anchors, etc.

Mainframes have typically been constructed of aluminum. In general practice, assembly of the mainframe to the pontoons requires that the mainframe rest directly on the pontoon surfaces. Significant problems have been associated with such direct-contact between the mainframe and pontoons. Friction between the surfaces of a pontoon and a frame during use of the boat causes black oxide to rub off of the mainframe and stain the pontoons and anything else coming in contact with the oxide. Aluminum mainframes also are easily scratched and dented during use, transportation and storage. Pontoon surfaces are subject to puncture and abrasion because of the conventional materials of construction of the pontoons, typically PVC, rubber, rubberized fabric or similar polymeric materials. Raised or rough areas on the mainframe cause cuts and abraded areas in the pontoon surfaces. To avoid staining, puncture and abrasion problems, boat owners require considerable time in maintaining the boat. The aluminum frame must be kept painted to avoid any direct surface contact between the mainframe and the pontoons; and any dents or nicks must be smoothed out before the mainframe can be attached to the pontoons.

Historically, these boats have been designed with wrap around mainframes supported on a pair of inflatable pontoons. The mainframe harnesses the pontoons in spaced parallel arrangement. The major portion of the frame is thus suspended between the pontoons as a support structure having side members, front and rear cross members and a central platform. Any additional boat components and accessories are attached to this support structure. Misalignment of the pontoons and mainframe create undesired operational problems in controlling the boat.

The bending moments generated in conventional mainframes have been observed to have a negative impact on the durability of the frame. The largest bending moments generated in the mainframe occur where the side members are joined to the central platform. Breakage often occurs in this area, especially under conditions causing the pontoons to bounce or the load to fluctuate (in rough water, for example). Overstress failures have also been observed to occur in the regions where foot rest and cargo bay accessories are attached to a frame.

Accessories are typically attached to side members of a mainframe, to be convenient to a boater's hand during boating. Unfortunately, any strap used to attach an accessory to a side member of the mainframe is inherently pushed into the pontoon surfaces when a mainframe is mounted on the pontoons. Other fastener systems and accessory surfaces moving against the pontoons also cause problems associated with wear. Vibration due to wind or rough water, or the transport of an assembled boat, causes abrasion of the pontoon surfaces under these pressure points.

Another commonly used method used to attach accessories to the mainframe side members is to fasten or integrally form a clevis at one end of the accessory. The clevis slips over a side member and is fixed in place. Oar locks, fishing rod holders, and beverage holders are examples of accessories that may be attached to a mainframe in this manner. Conventionally, clevis and side members have been made of aluminum. Galling between the clevis and side member surfaces has been found to present a significant problem after short usage times.

Wrap around mainframes are intended to provide stability along the full length of each pontoon and maintain the pontoon pair in parallel position even in relatively rough water conditions. Unfortunately, some conventional wrap around design obstructs a user's entry and exit from the vessel. This problem increases with increasing water depth. Historically, the front cross member of a mainframe has acted as a footrest. A footrest provides many practical advantages; for example, for generally relaxing, for resting and stretching finning muscles, or for supporting a user's feet in an elevated position to clear bottom hazards. It also may serve as a foot brace for more efficient rowing action.

A framing system which eliminates front cross members offers convenient walk-in access to the vessel's seating area, but with the accompanying loss of the footrest. "L"-shaped foot rest extensions have thus been attached to the side members of certain mainframes lacking a front cross member. Neither the conventional front cross member nor the newer foot rest extension is continuously adjustable to comfortably accommodate various leg lengths.

It is recognized that it would be beneficial to provide adequate leg support above the surface of a kick boat's foot rest. Such leg support would be expected to alleviate leg strain when the feet are elevated. Hypothetically, a cross member could provide additional leg support with the use of a foot rest attachment suspended from and located forward of the member, but only if the user's legs, through serendipity, happened to be of the correct length to take advantage of such a feature.

Many pontoon boat accessories are available to enhance user comfort and convenience. Historically, it has been difficult to attach accessories to the mainframe in a manner avoiding entanglement of the boater or abrasion of the pontoons, and to avoid clutter, while allowing the accessory to be easily accessed when wanted. Historically, accessories are provided to serve a single function. It would be of benefit to provide adaptable accessories that can meet a variety of needs, to eliminate clutter.

Conventional boat models are provided with the aim of meeting the needs of boaters primarily interested in one particular type of application. Boats configured for lake fishing are not necessarily convenient for river fishing or river running for example. A versatile boat that can be configured to meet a variety of needs would be highly advantageous.

Storage of inflatable pontoon boats has been inconvenient for those, such as apartment dwellers, having limited storage space. These boats have generally been bulky, even when disassembled for storage or transport. Duffle bags and bags with attached back pack straps have been used to increase boat portability.

Swept pontoons are being offered to replace the previously favored cylindrical pontoons in some applications. When viewed in a longitudinal cross section, cylindrical pontoons have parallel walls over the water contact area, that rest flat on the water. Swept pontoons may include a cylindrical midsection, but are otherwise characterized by converging walls that curve up away from the plane of the water surface. Fully swept pontoons have no cylindrical sections and are offered with varying radii of curvature.

Swept pontoons greatly decrease the water resistance of the boats and allow for greater maneuverability and easy propulsion action. However, boats utilizing swept pontoons are less stable in the water and so are less forgiving of longitudinal load imbalances. Therefore, there is an increased need for adjustability in situating the mainframe longitudinally along the pontoons, to balance the load carried by the pontoons. Further, there is an increase necessity in maintaining the frame attached to the pontoons at a precise and repetitive location for each assembly of the craft.

Various attempts have been made to accommodate the needs and desires of boaters to provide individual watercrafts for various types of activities, such as fishing, sightseeing or exploring rivers and streams, separately or together. Often, families will have two or more individual watercrafts to satisfy the desires of the family members. On occasions, only one person may want to go boating and/or fishing and at other times two members may want to go boating together and perhaps take turns rowing and fishing. Such occasions would require either an individual boat or a two-person boat. Likewise, family friends and neighbors may have the same interest as families in boating separately or together. This presents a dilemma with families and friends as to whether they should acquire single-person boats or two-person boats. Further, on such occasions, families and friends on reaching the recreational area for boating and fishing, may then decide to fish or explore, separately or together, again providing a dilemma as to whether they should have a two-person boat or a one-person boat.

The joining of two individual watercrafts to act as one is a desirable arrangement. However, prior attempts have suggested that one pontoon boat can be arranged to have parallel seating arrangements to accommodate one or two boaters. Others have suggested longitudinal linking of modular sections between fore and aft sections to accommodate several individuals. Such arrangements do not permit individuals to separate the watercraft into two separate boats because the modular sections require a bow and stern section to be a usable craft.

The ideal situation would be the ability to join two individual watercrafts as one for use by two individuals or maintain the watercrafts separate with each individual using one boat. The joining of two separate boats to provide a two-person boat also allows one person to maneuver the craft while the other concentrates on fishing or other activities without concern of navigating streams or rivers.

There remains a need for a versatile boat with adjustable and secure foot, leg and seat support structures, improved storage, and reduced maintenance requirements. There further remains a need for a boat assembly capable of more efficient storage and transport, and for a safe, durable, and collapsible design that provides rigid stability when reassembled. There is also a need for improved load balancing capabilities for swept pontoon boats. Elimination of the need for tools and loose hardware for assembly and disassembly would eliminate a major source of inconvenience, and would help reduce weight, thereby enhancing portability. Improved accessory storage and an adjustable and safe stripping apron are also needed.

Further, there remains a need for joining two versatile boats by simple means whereby the bow of one boat is coupled to the stern of another boat in such a manner as to form a two-person craft from two individual crafts that retain all the amenities and accessories of a single craft, which allow for joining the crafts as one in the field for various periods of time with the ability to disjoin the craft to accommodate navigation of smaller waterway or tributaries of a larger body of water where the craft coupled in tandem are readily maneuverable.

SUMMARY OF THE INVENTION

The present invention is an improved pontoon watercraft which includes inflatable pontoons and a yoke assembly for spacing the pontoons in a parallel orientation with a central support for mounting a seat, cargo rack, motor support and anchor mounting and a pair of foot rests. The yoke assembly may be assembled and disassembled without any special tools. The yoke assembly has gunwales for supporting oar locks and oars. The high-rise pontoons provide appropriate contact with the water.

The present invention provides a personal pontoon watercraft that may be assembled and disassembled with no special tools and minimum of equipment for inflating the pontoons. When disassembled the watercraft may be stored in a relatively small canvass or other suitable bag having a length of four (4) feet and a girth of six to seven (6–7) feet. The watercraft comprises two inflatable pontoons which may be twin bladder pontoons to provide extra puncture protection; a yoke frame having two yoke members contoured to and encircle the top surface of the pontoons, which are spaced-apart by a central support; each yoke member is retained secured to the central support by struts projecting from the yoke member with snap button locks that seat in apertures in cross bars of the central support; the yoke frame accommodates an integrated load leveling system, as well as, oar locks, oars, trolling motor and anchor mount.

Further, the present invention provides a personal pontoon watercraft which includes twin bladders in each pontoon for inflating the pontoons and minimize catastrophic puncture of both pontoons. The pontoons are held by a yoke frame in which the yoke members encircle the top side of the pontoons and are contoured thereto. This maintains the pontoons upright when properly secured. The yoke frame includes D-ring tie downs for securing the pontoon straps which encircle and are secured to the under side of the pontoons, and in conjunction with the D-ring tie downs maintain the pontoons parallel and symmetrical with respect to each other in order to maintain balance and stability of the personal pontoon watercraft.

In order to accomplish this symmetry, the straps, generally of nylon webbing, are sewn or otherwise affixed to each of the pontoons precisely the same. First, a long strap, which is sufficient to encircle the underside of the pontoon and extend through the D-ring tie downs, back down and thread through a buckle, is sewn or otherwise secured along the underside of each pontoon oriented in a circular plane through the pontoon such that the longitudinal axis of the pontoon is perpendicular to the circular plane. Next, with the same orientation as the long strap, a shorter strap with a buckle attached to each end, is sewn or otherwise affixed over the long strap along the under side. Additionally, a strip of same material as the pontoons is over sewn or secured covering the web straps along the underside to protect them from underwater and shore line damage. Each pontoon has two sets of these straps appropriately spaced for attachment to the D-ring tie downs on the yoke frame. The positioning of the straps with the longitudinal axis of the pontoons perpendicular to the circular plane of the straps assures that with repeated assembly and disassembly of the pontoon watercraft, the pontoons will always be properly aligned when attached to the yoke frame. The yoke frame with the D-ring tie downs will always maintain the pontoons of the watercraft symmetrical and parallel.

Further, the present invention provides the personal pontoon watercraft with an integrated load leveling system whereby the individual can adjust leg rests to multiple positions, adjust the seat forward or backward in several positions, provide gunwales with oar locks that may be adjusted to several forward or rearward positions, and adjust the motor and anchor mount to several forward or rearward positions, for the purpose of individual comfort and maintaining the watercraft level in the water such that the center of gravity will prevent the watercraft from constantly turning around to seek the direction of water flow with the end sitting deeper in the water, turning down stream. Likewise, the center of gravity may be adjusted to maintain the bow deeper in the water to follow the stream flow.

The two piece oars are designed to snap together with two snap button locks oriented with the buttons in separate circular planes and angularly displaced from each other by ninety (90°) degrees which prevents inadvertent separation of the two sections by the user or from the oar snagging on an underwater or narrow watercourse obstruction.

Other features include a reinforced tubular motor and anchor mount at a convenient height above the water line, a slide out mesh fish basket, a wire mesh storage compartment, Velcro fastener retained nylon side storage boxes, and the like.

In another aspect of the invention, the design of the personal pontoon watercraft is modified to provide the removal of the foot rest from the bow of one boat and the removal of the motor and anchor mount from the stern of another boat. In addition, the pontoons of each craft are designed with a zipper, one side encircling the fore end and the other encircling the aft end of the pontoons, in such a fashion that the aft ends of the pontoons of one craft may be slightly deflated along with the for end of the other craft's pontoons, which can then be mated together forming unitary pontoons between the two boats. In this manner, the pontoons of two separate watercrafts may be joined and a coupling frame can join the frames of the two watercrafts to form a single rigid frame with the rear boat retaining the motor and anchor mount and the forward boat retaining the foot rest. The coupling frame may be several horizontal struts to provide foot rests for the rear craft when joined with the forward craft.

In a further arrangement, the watercraft when paired in tandem will accommodate a standing fishing platform by removing the foot rest from the central support of the yoke assembly of the forward craft and inserting the standing platform with railing in the central support of the yoke assembly where the foot rest was removed. This change requires no special tools as the assembly uses snap-button lock for ease of assembly and disassembly. In addition the swivel seat of the watercraft may readily be removed and a pedestal seat of adjustable height and swivel may be attached by unthreading wing nuts and bolts that hold the seat in place and securing the pedestal seat with wing nuts and bolts.

DETAILED DESCRIPTION OF THE PREFERRED EMBODIMENT

Figure 1:
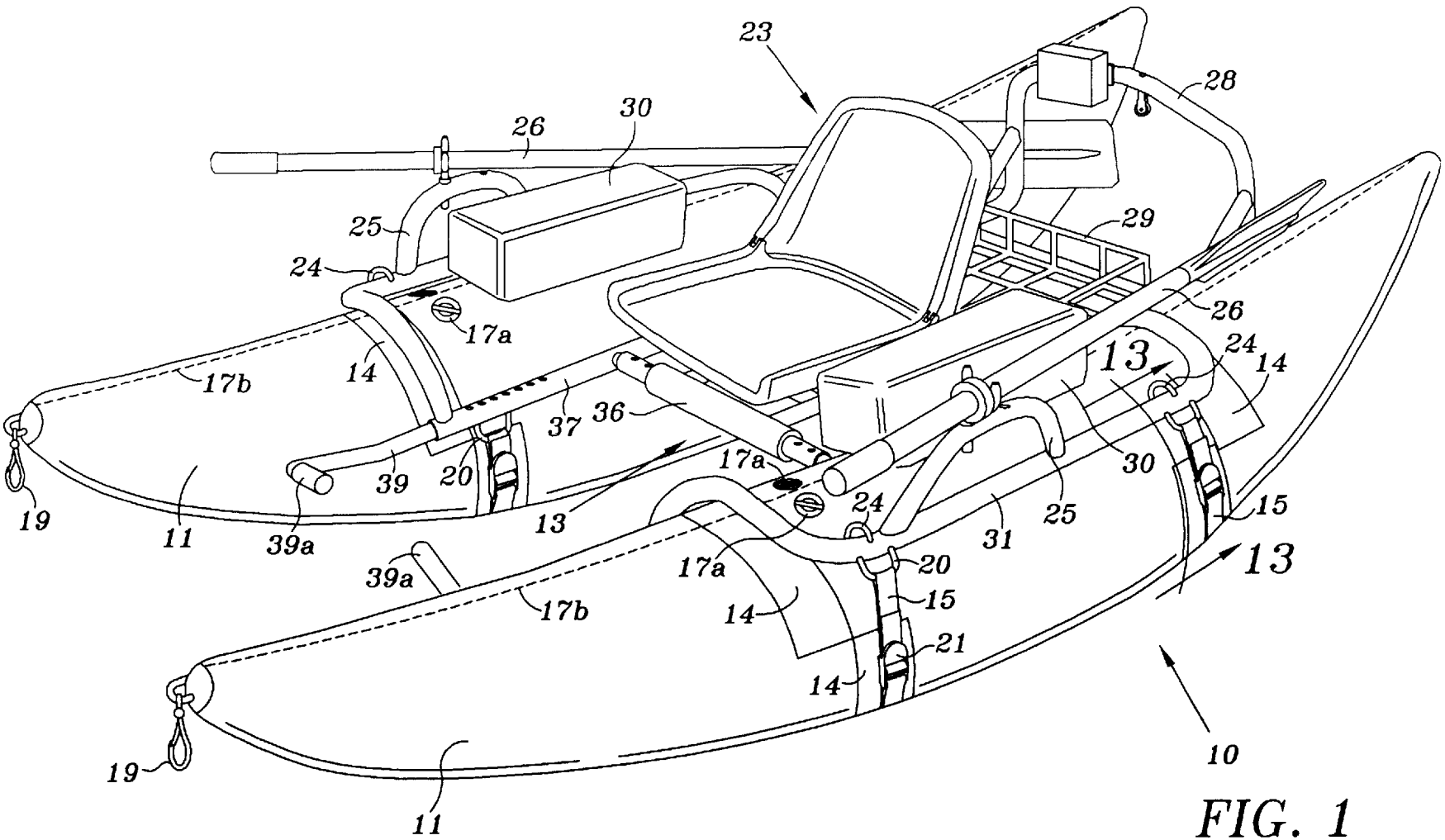
FIG. 1 is a pictorial view of the pontoon watercraft fully assembled and ready for launching.
Figure 14:
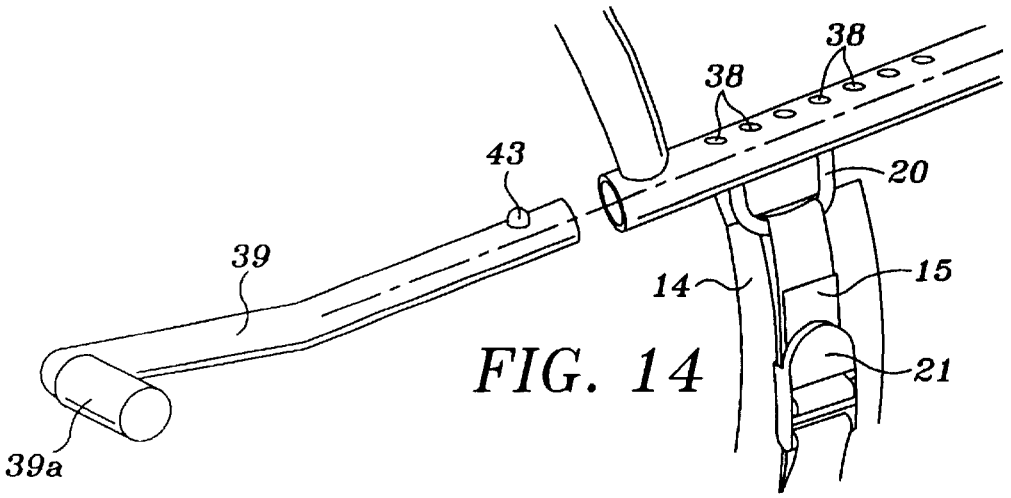
FIG. 14 illustrates the buckle and strap arrangement for securing the yoke frame to the pontoons.
Figure 2:
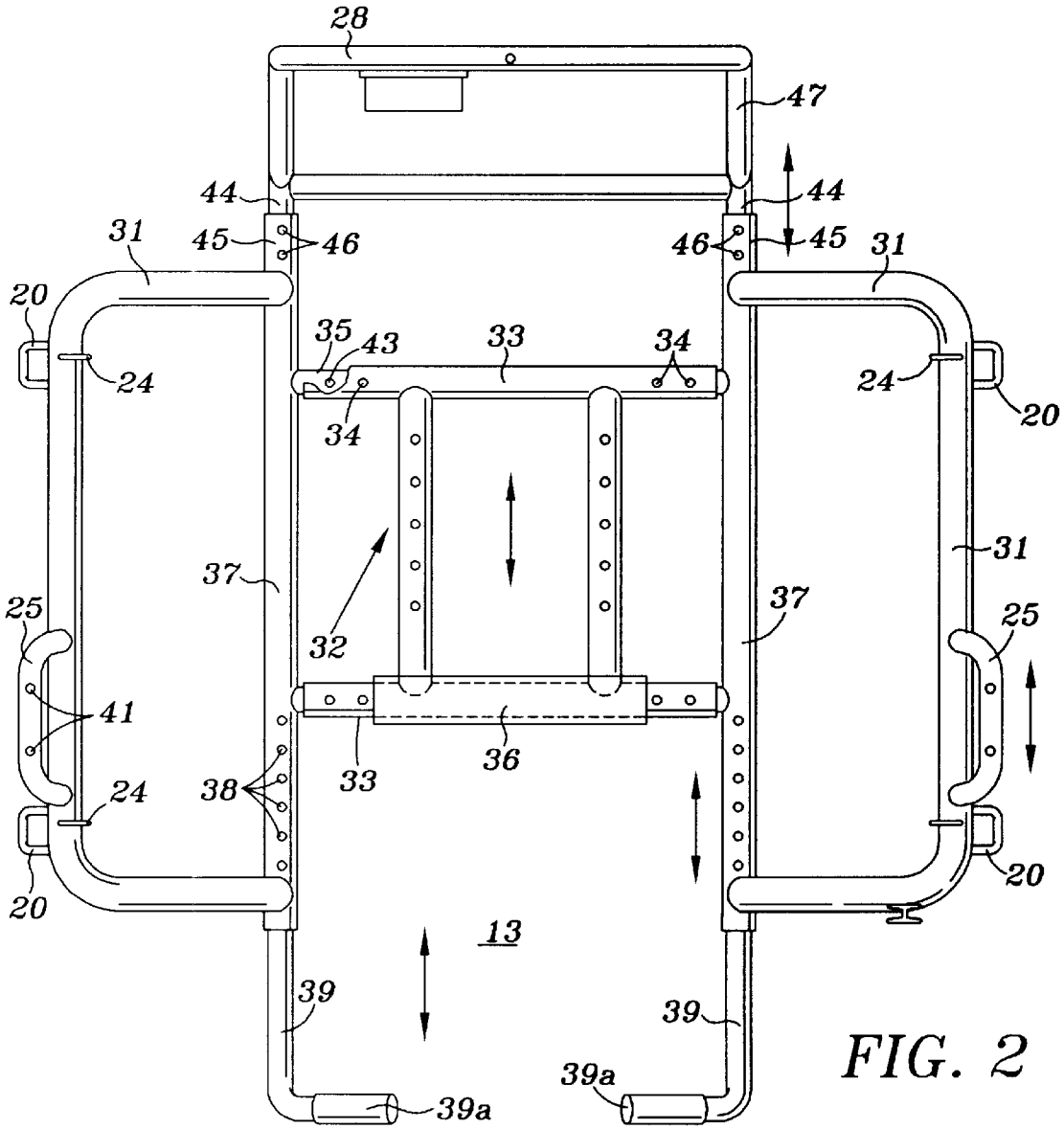
FIG. 2 is a top view of the yoke frame assembled with foot rests and motor mount in place.
Figure 3:
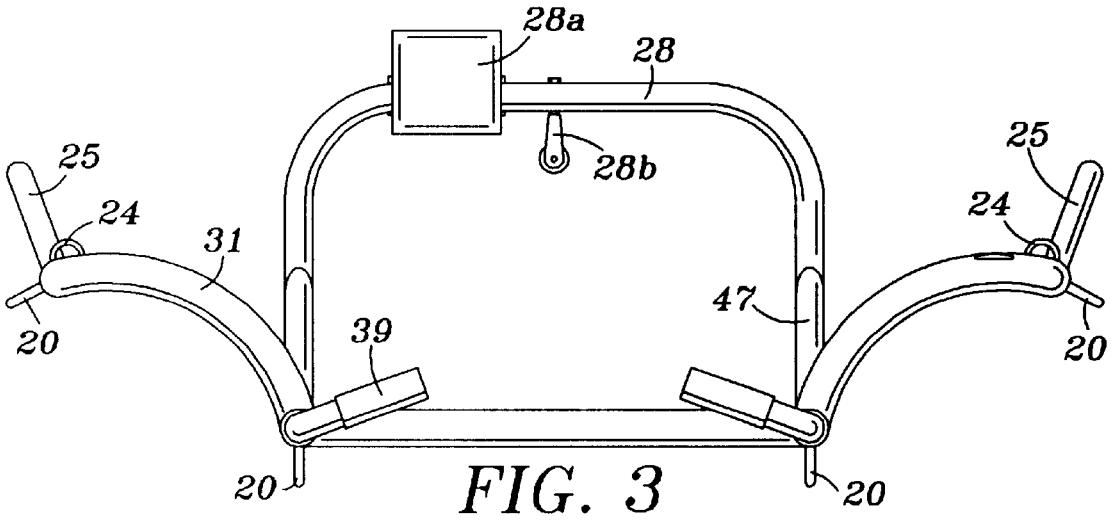
FIG. 3 is a front view yoke frame with motor mount.
Figure 4:
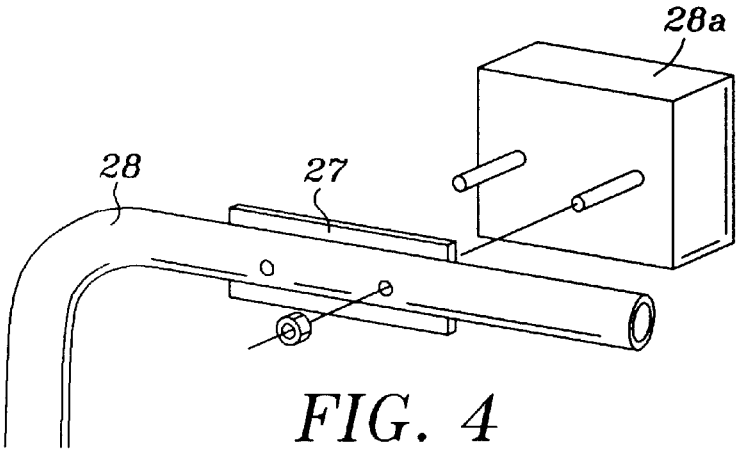
FIG. 4 is an exploded fragmented view of the motor support and anchor mount illustrating the mounting.
Figure 5:
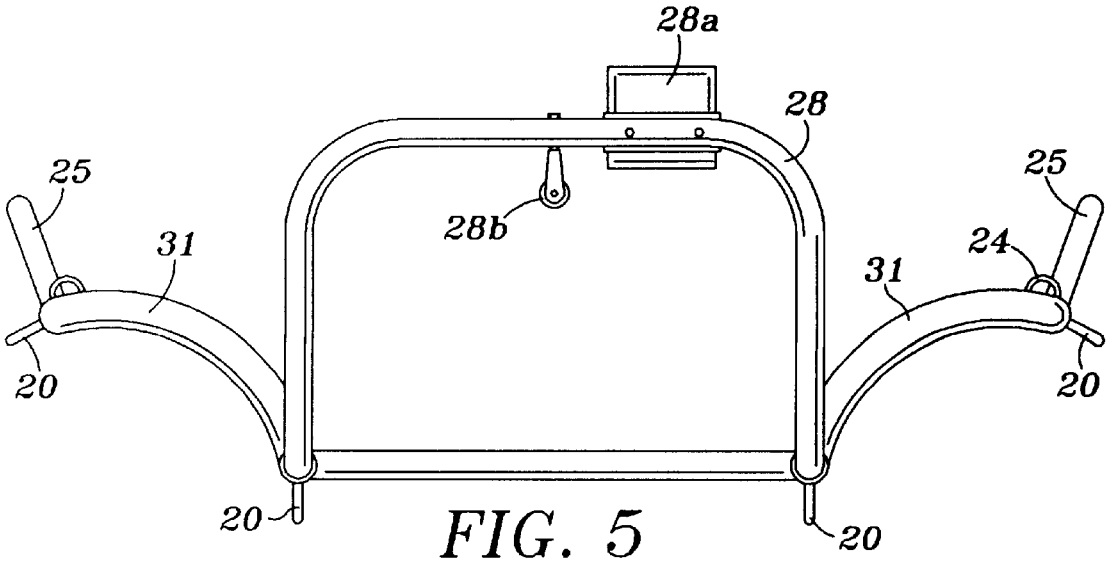
FIG. 5 is a back view of the yoke frame with motor mount.
Figure 6:
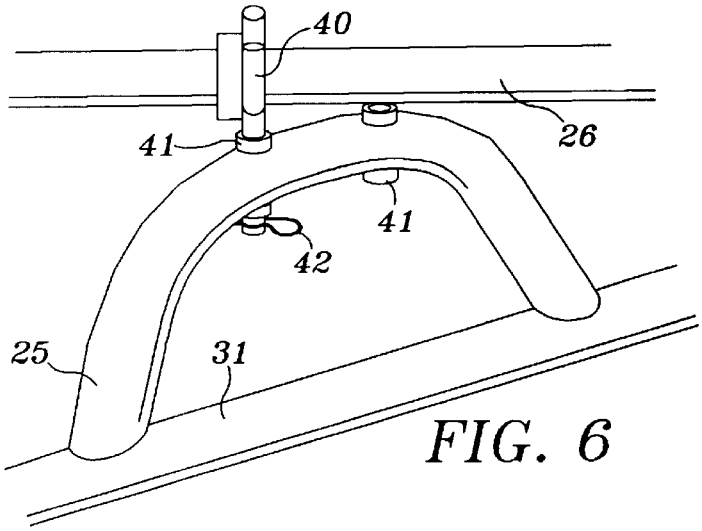
FIG. 6 illustrates the gunwales with oar lock and oar mounting.
Figure 7:
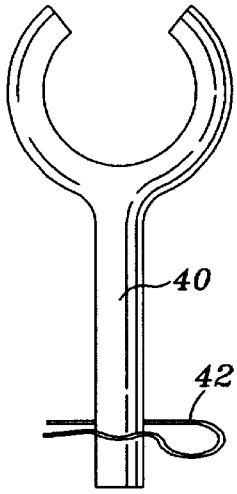
FIG. 7 illustrates the oar lock and security clip.
Figure 8:
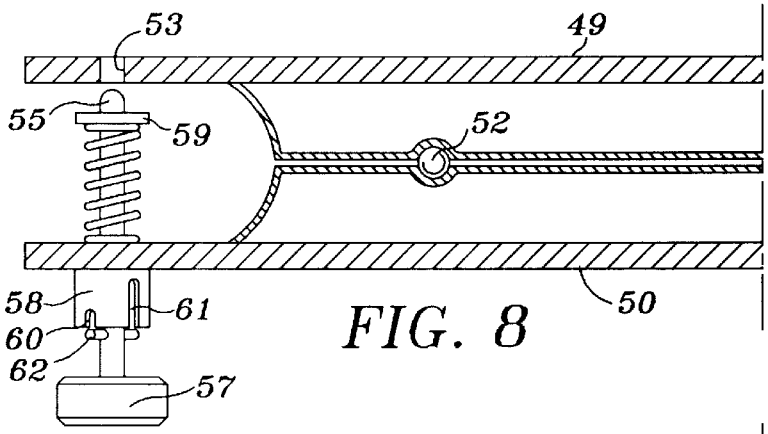
FIG. 8 illustrates a partial sectional view of the seat mount illustrated in FIGS. 18 and 19 with the seat latching mechanism unlocked.

Referring now to FIGS. 1 through 19, and in particular FIGS. 1 through 12, a pontoon watercraft 10 is illustrated. The watercraft 10 has a pair of inflatable pontoons 11, having a yoke frame generally 13. Yoke frame 13 is seated on pontoons 11 on reinforcing strips 14 and held in place by straps 15 with buckles 21 as more fully described later. Folding seat 23 is mounted on yoke frame 13. Gunwales 25 which are part of yoke frame 13 mount two piece oars 26. Motor and anchor mount 28 is attached to the rear of yoke frame 13. Cargo basket 29 is positioned over the rear portion of yoke frame 13. Storage compartments 30 are detachably mounted to pontoons 11 by Velcro fastener or the like.

Referring now to FIGS. 2 through 5, yoke frame 13 includes yoke members 31, one on the port side and one on the starboard side of watercraft 10. Each yoke member 31 is contoured to seat on reinforcing strips 14 of each pontoon 11. Yoke members 31 are spaced apart by a central support or seat mount 32. Inmost rails 37 of yoke members 31 include struts or side butts 35 with snap button locks 43 which seat in cross members 33 of seat mount 32 with snap button locks 43 seated in apertures 34. The forward cross member 33 may include padding 36 to cushion contact of users legs when maneuvering the craft. Yoke members 31 support D-rings 20 and gunwales 25. Inmost rails 37 of yoke mount 31 have six apertures 38 that accommodate snap button locks 43 on foot rest 39 which are inserted in inmost rails 37 and provide six positions for adjusting the footrests 39. Likewise, gunwales 25 oar lock mounting inserts 41 which provide two positions for mounting the oar locks 40. If desired the oar lock mounting inserts 41 could be provided with more than two positions by increasing the length of gunwales 25, see FIG. 6. The oar locks 40 are held in oar lock mounting inserts 41 by oar lock clips 42. Motor and anchor mount 28 have feet 44 that adjustably seat in rear projections 45 of inmost rails 37 and have apertures 46 to receive snap button locks 43 mounted on feet 44. For extra stability motor and anchor mount 28 has struts 47. Motor and anchor mount 28 has a motor mount 28*a* and an anchor mount 28*b*.

Referring now, in particular, to FIGS. 8, 9, 18 and 19, the swivel arrangement for folding seat 23 is best illustrated. Seat swivel 48 consists of upper plate 49 and lower plate 50 which is secured on central pivot 51 with ball bearings 52. Upper plate 49 has an aperture 53 which seats locking pin 55 when the swivel seat is in the locked position. The seat swivel 48 locking arrangement includes locking pin 55, spring 56 with spring retainer 59, knob 57, sleeve 58 with a short slot 60 and deep slot 61. Locking pin 55 has lugs 62 adapted to seat in short slot 60 or deep slot 61 to allow seat 23 to swivel or to lock seat 23 in place. Seat swivel 48 is attached to seat mount 32 in aperture 63 of seat mount 32. Suitable fasteners such as bolts 54 with wing nuts 65 may be used to attach seat swivel 48 to seat mounts 32. Seat 23 is secured to upper plate 49 by suitable fasteners. Seat back 23*a* and seat bottom 23*b* are hinged by sex bolt 64 secured on each side of seat bottom 23*b* and seat back 23*a*.

Figure 12:
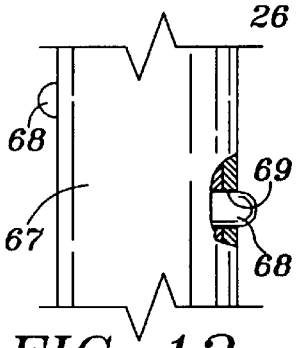
FIG. 12 is a partial top view of the oar in FIG. 10 illustrating the displacement of the snap locks.
Figure 9:
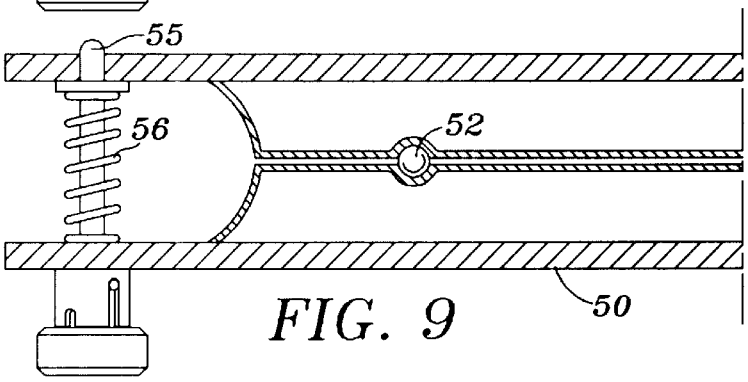
FIG. 9 illustrates a partial sectional view of the seat mount illustrated in FIGS. 18 and 19 with the seat latching mechanism locked.
Figure 11:
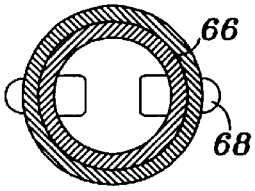
FIG. 11 is a cross section taken along lines of 11—11 in FIG. 10 illustrating the snap button locks for maintaining the two pieces of the oar connected.
Figure 10:
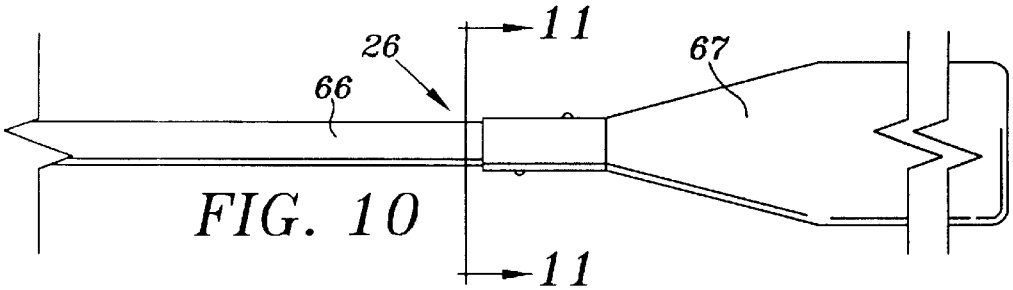
FIG. 10 illustrates the two piece oar.

The two piece oars are best illustrated in FIGS. 10, 11 and 12. Each oar 26 has shank end 66 and blade member 67. Shank member 66 has snap button locks 68 which seat in aperture 69. Snap button locks 68 are in different planes and spaced apart to maintain oars 26 connected without inadvertent separation by accidentally pushing one of the snap button locks 68 or the oar 26 being snagged on something in the water.

Figure 15:
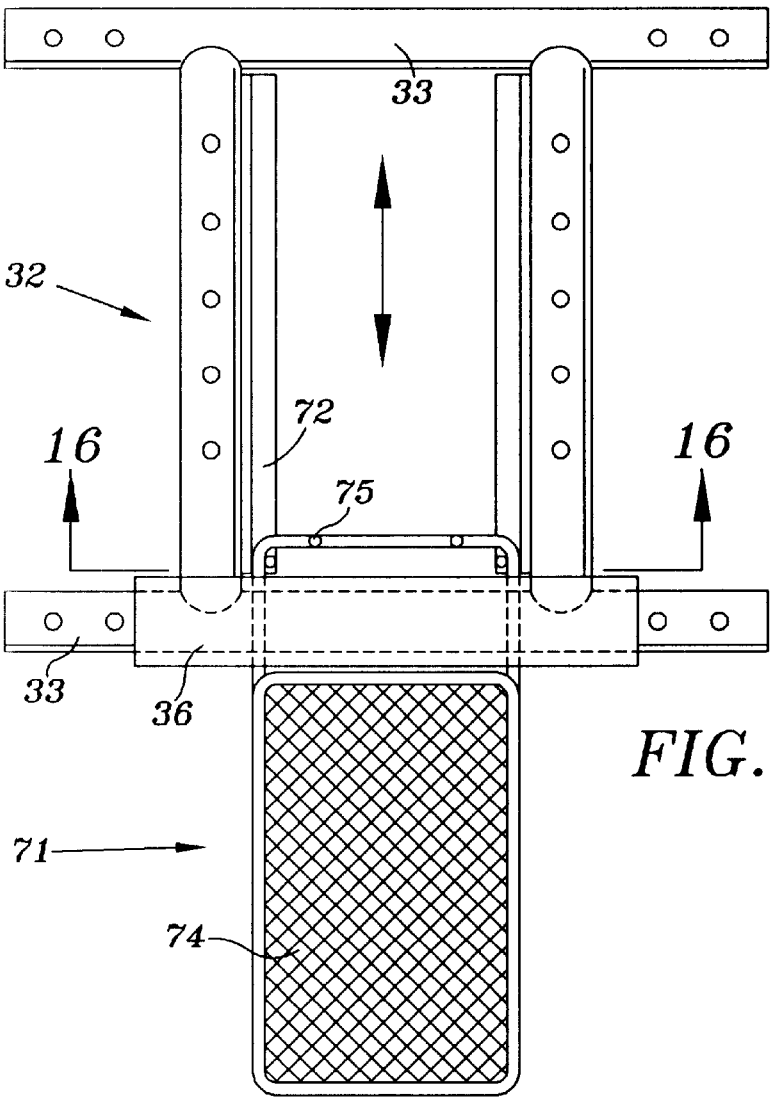
FIG. 15 illustrates a fish basket which is extended from under the seat illustrated in FIG. 18.
Figure 16:
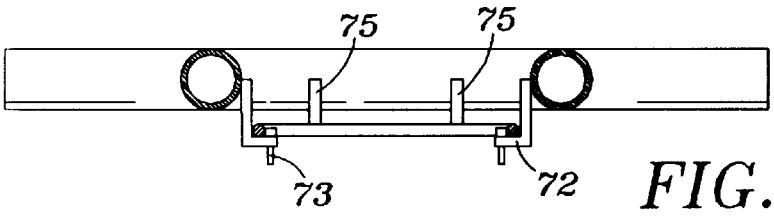
FIG. 16 is a cross sectional view taken along lines 16—16 in FIG. 15.
Figure 17:
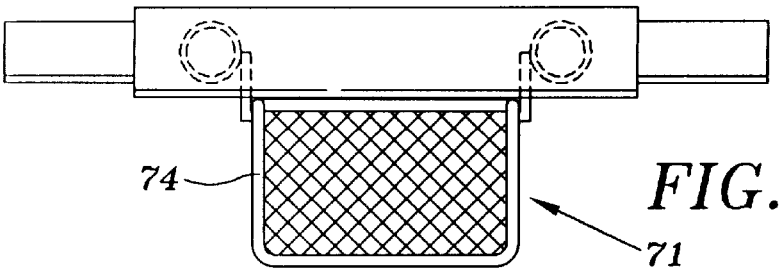
FIG. 17 is a front view of the fish basket in FIG. 15.

Referring to FIGS. 15, 16 and 17, fish basket 71 slideably mounts beneath seat mount 32. Bracket 72 slideably mounts fish basket 71. Bracket 72 has stops 73 which engage rims 74 on fish basket 71 to prevent it from inadvertently being pulled completely out from under seat 23. Rim 74 has stops 75 which engage cross members 33 at the back of seat mount 32 to prevent fish basket 71 from sliding out of bracket 72 at the rear of seat frame 32.

Figure 13:
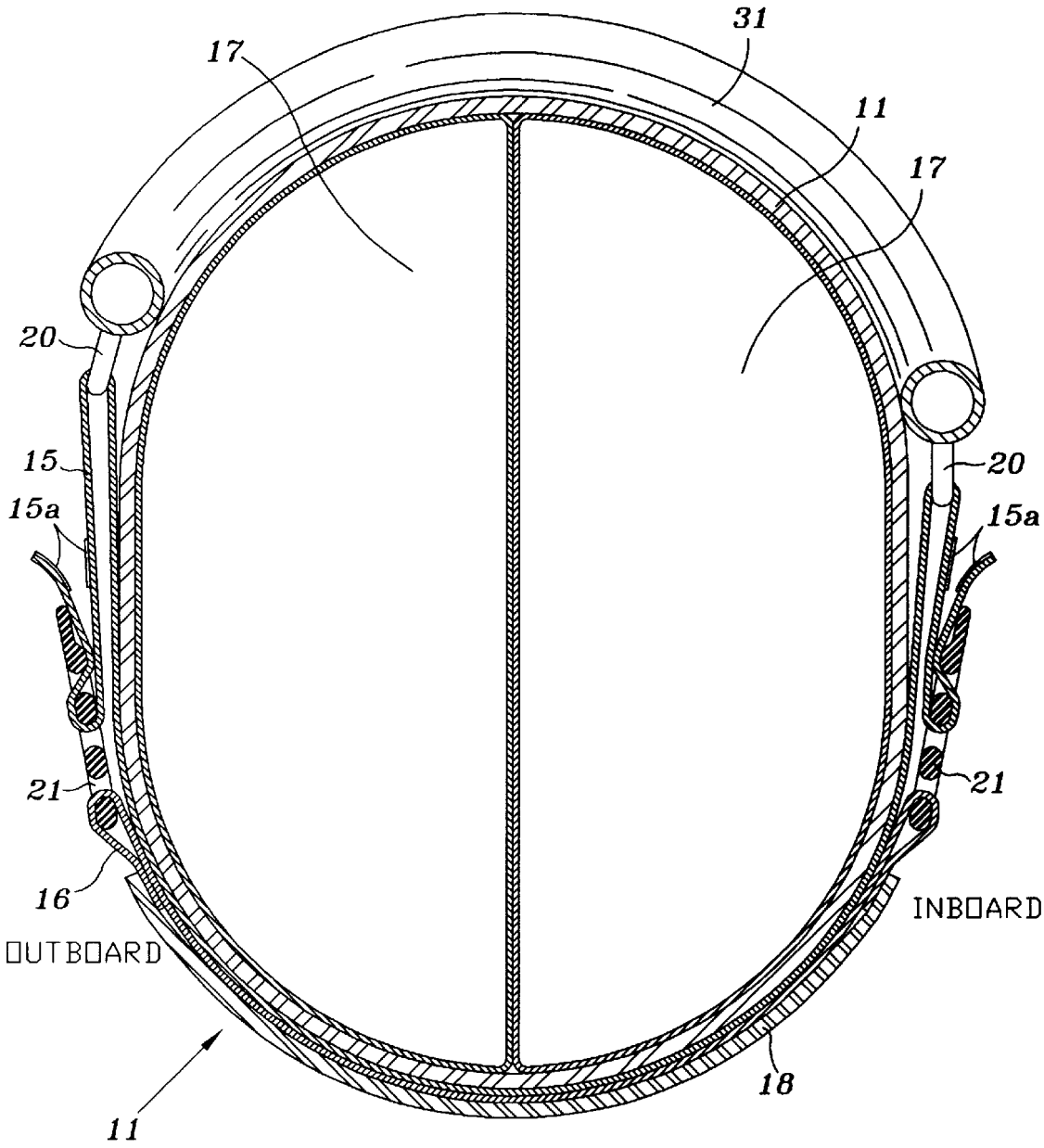
FIG. 13 is a partial sectional view taken of the pontoon along lines 13—13 in FIG. 1 illustrating the construction of the pontoon.

Referring now to FIGS. 1 and 13, each pontoon 11 has twin bladders 17 with air valves 17*a* for inflating and deflating pontoons 11. Pontoon 11 is nylon PVC coated material which is seam welded along lines 17*b*. Pontoons 11 have nylon web strap 15 which extends beneath pontoon 11 between D-ring brackets 20 on the outboard and inboard side of pontoon 11. A short second strap 16 extends beneath pontoon 11 on top of strap 15. Strap 16 retains each buckle 21 attached approximately just above the water line of pontoon 11. Straps 15 and 16 are sewn to bottoms of pontoon 11 and a covering 18 of the same nylon PVC coated material as used for pontoon 11 is sewn thereover to provide protection for straps 15 and 16 when the watercraft 10 engages underwater objects or the bottom, as well as, moving the watercraft in and out of the water along the shoreline. Straps 15 also have Velcro fasteners to hold the ends of strap 15 against itself once the pontoons 11 have been properly secured to the yoke frame 13. The forward ends of each pontoon 11 have a convenient attachment loop 19 such that the watercraft could be hauled or otherwise towed as desired.

The pontoon watercraft 10 is assembled in the following manner, the main parts of yoke frame 13 are yoke members 31 and seat mount 32. The twin bladders 17 of pontoons 11 are inflated through valves 17*a* with sufficient air to fully inflate pontoons 11 which should be relatively firm. Once the pontoons 11 have been inflated the yoke frame 13 is assembled by depressing the snap button locks 43 used throughout the assembly and inserting the struts 35 in cross members 33 of seat mount 32. Prior to this assembly the seat swivel 48 is secured through aperture 63. Lower plate 50 of seat swivel 48 is bolted in the desired position in aperture 63 of seat mount 32. Upper plate is likewise attached in any suitable manner to seat bottom 23*b*. Once yoke frame 13 is assembled, then it is placed over pontoons 11 and pontoons 11 adjusted so that the yoke members 31 seat on reinforcing strips 14 and D-rings 20 on yoke members 31 are oriented in alignment with straps 15 on either side of pontoons 11. Straps 15 are threaded through D-rings 20 then down through the bottom slot and back through the top slot in buckles 21. Straps 15 are tightened by pulling up on straps 15 which engage serrated edges of buckles 21 to hold pontoons 11 securely to yoke frame 13.

The preferred embodiment of composite watercraft 100 is best understood with referenced to FIGS. 20 through 29. Composite watercraft 100 combines watercraft 110 in FIG. 21 and watercraft 120 in FIG. 22. It should be noted that watercraft 110 is almost identical with pontoon watercraft 10 and includes yoke frame 13, illustrated in FIG. 2, foot rest 29 and motor and anchor mount 28. Moreover, watercraft 120 is also similar to pontoon watercraft 10 and includes yoke frame 13, illustrated in FIG. 2, foot rest 29 and motor and anchor mount 28. Further referring to FIGS. 23, 24 and 25; however, watercraft 110 has zippers 112 hidden by collar 113 on aft ends 115. Likewise, watercraft 120 has zippers 122 hidden by collar 123 on fore ends 125.

In order to assemble individual watercraft 110 with individual watercraft 120 to form composite watercraft 100, motor and anchor mount 28 is removed by depressing snap-button locks 43 from apertures 46. Likewise, on watercraft 120, snap-button lock 43 on footrest 39 are depressed from apertures 38 and foot rest 39 is removed.

Pontoon watercraft 110 and pontoon watercraft 120 are now ready to be joined. In order to do so, aft ends 115 of pontoons 111 are slightly deflated along with fore ends 125 of pontoons 121. Next, lattice work, generally referred to as 130, includes two parallel bars 131 spaced by two horizontal bars 132. Bars 131 have long ends 134 and short ends 136. With pontoons 111 and 121 slightly deflated, long ends 134 of lattice work 130 are inserted in innermost rails 37 of yoke member 31, in apertures 46 until snap-button locks 137 engage apertures 46 (see FIG. 2). Likewise, foot rest 39 is removed by pressing snap-button locks 43 and pulling foot rest 39 out of innermost rails 37 with longs ends 134 of lattice work 130 remaining locked in innermost rails 37, with snap-button locks 137 engaged in apertures 38. Short ends 136 of side rails 131 are inserted into innermost rails 37 until snap-button locks 137 engage apertures 38, such that fore ends 125 of pontoons 121 are fully mated with aft ends 115 of pontoons 111. Once lattice work 130 is fully engaged with watercrafts 110 and 120, zippers halves 112 and 122 are mated to physically fasten aft ends 115 of pontoons 111 to aft ends 125 of pontoons 121. Collar 113 is then overlaid on top of collar 123 to provide a smooth juncture between aft ends 115 of pontoons 111 with fore ends 125 of pontoons 121.

In assembling watercraft 110 with watercraft 120 to form composite watercraft 100, fore ends 125 of pontoons 121 may be left inflated and aft ends 115 of pontoons 111 would be deflated sufficiently for fore ends 125 on pontoons 121 to nestle into aft ends 115 of pontoons 111. Further it should be understood that lattice work 130 is alone sufficient to maintain pontoons 111 nestled with pontoons 121, but for convenience, the possibility of rough water causing the pontoons to be distorted and separated is prevented by meshing zipper half 112 with zipper half 122 to secure aft ends 115 of pontoons 111 with fore ends 125 of pontoons 121. This could be accomplished with Velcro fasteners in which zipper half 122 is replaced with male Velcro strip, zipper 112 eliminated and collar 112 having its inside formed with female Velcro strip.

Figure 18:
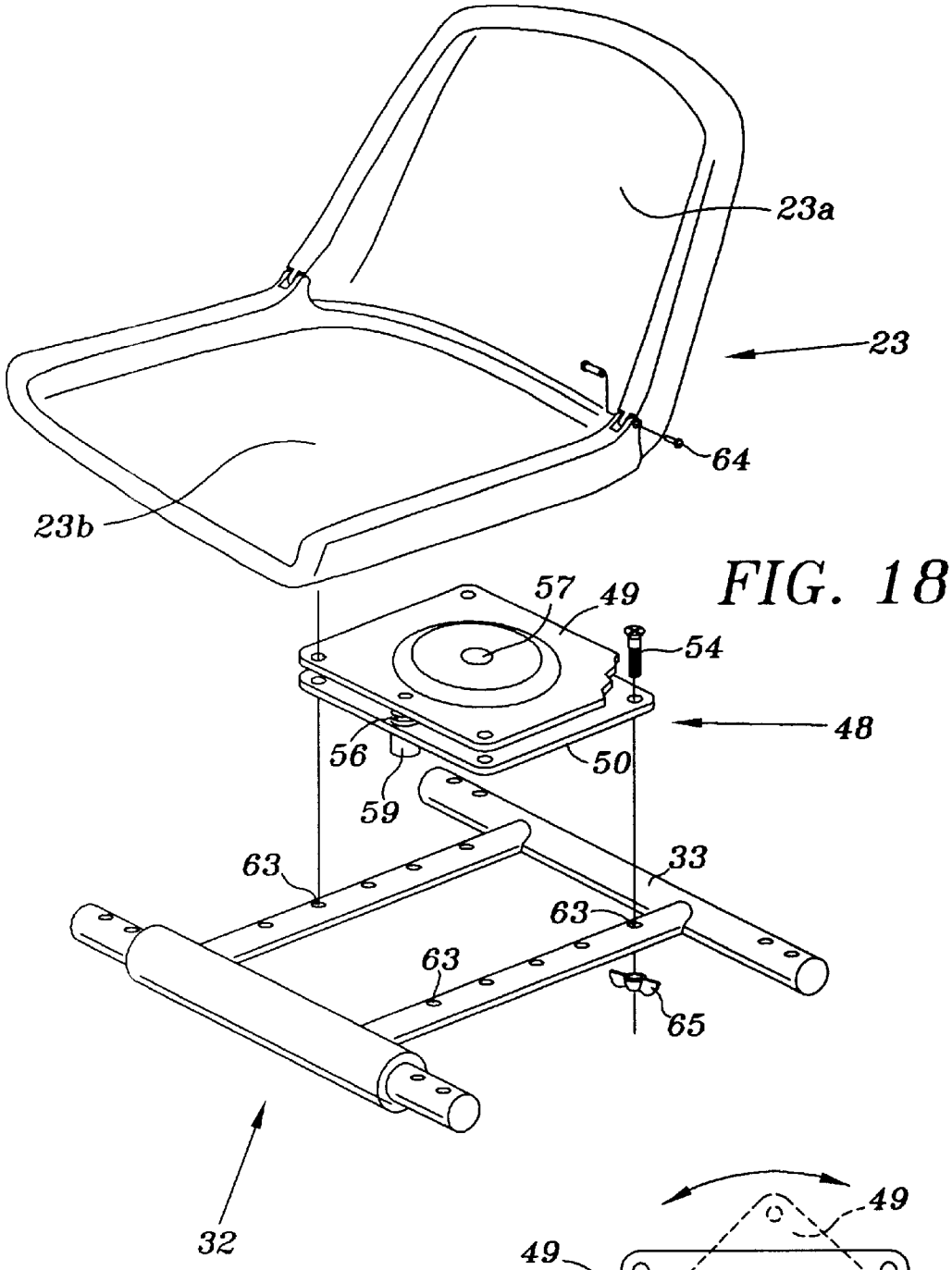
FIG. 18 is an exploded view of the seat and swivel mounting oriented with the central part of the yoke frame.
Figure 19:
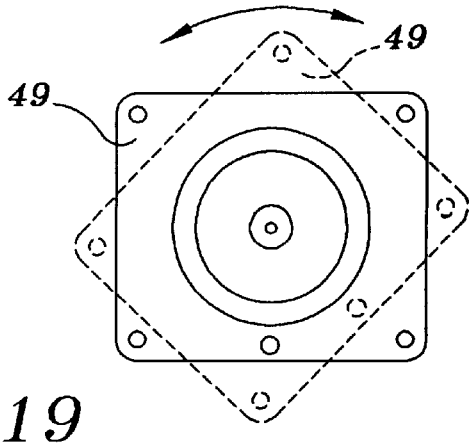
FIG. 19 is a top view illustrating the movement of the swivel mount of the seat.
Figure 20:
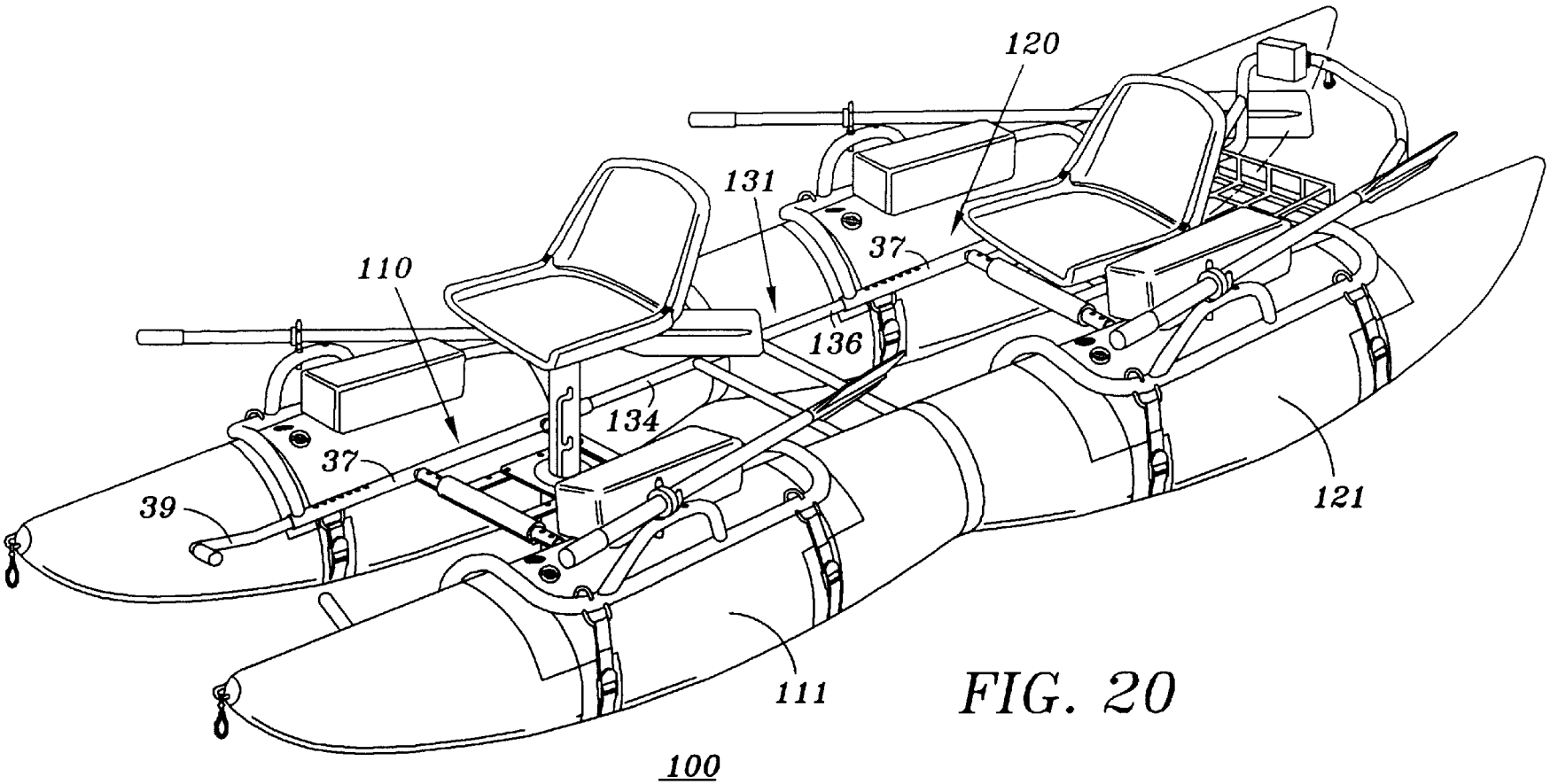
FIG. 20 is a perspective view of the composite watercraft with the telescoping pedestal seat on the forward watercraft.
Figure 21:
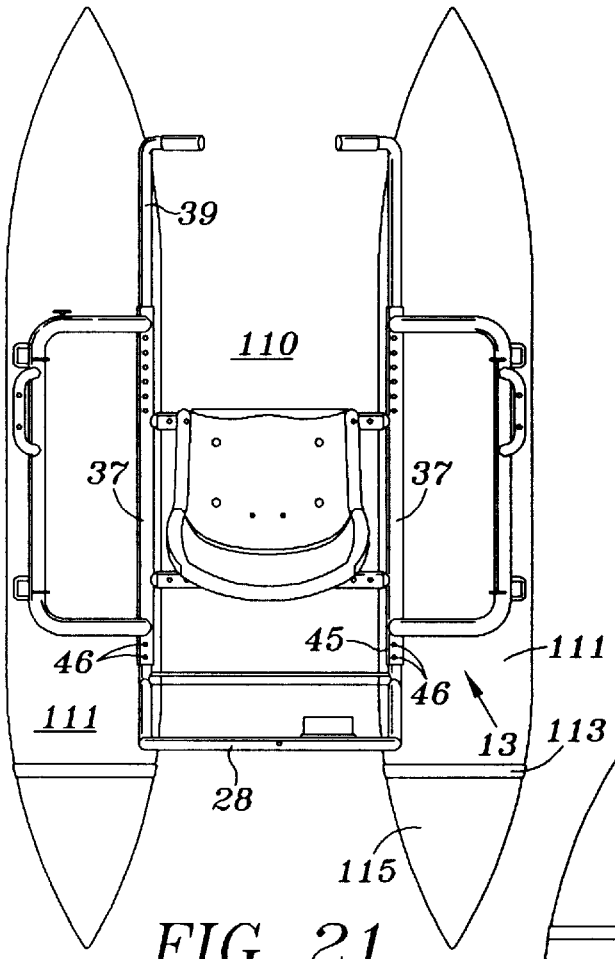
FIG. 21 is a plan view of an individual boat with the attaching devices encircling the aft ends of the pontoons.
Figure 24:
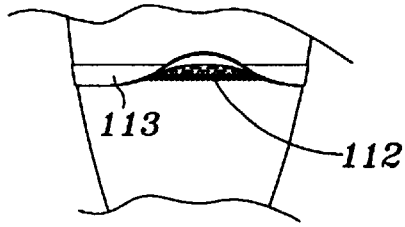
FIG. 24 is a partial view of the pontoon in FIG. 21 with the fastener and collar exposed.
Figure 25:
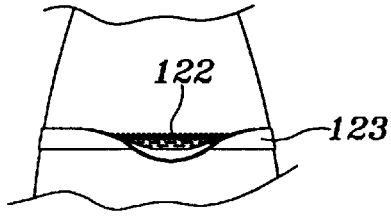
FIG. 25 is partial view of the pontoon in FIG. 22 with the fastener and collar exposed.
Figure 23:
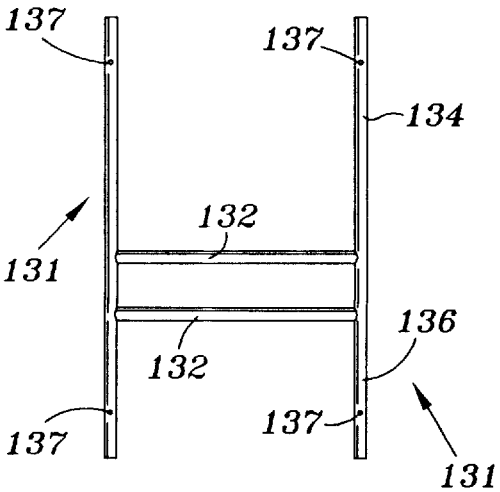
FIG. 23 illustrates the lattice work for linking the watercraft in FIG. 21 with the watercraft in FIG. 22.
Figure 22:
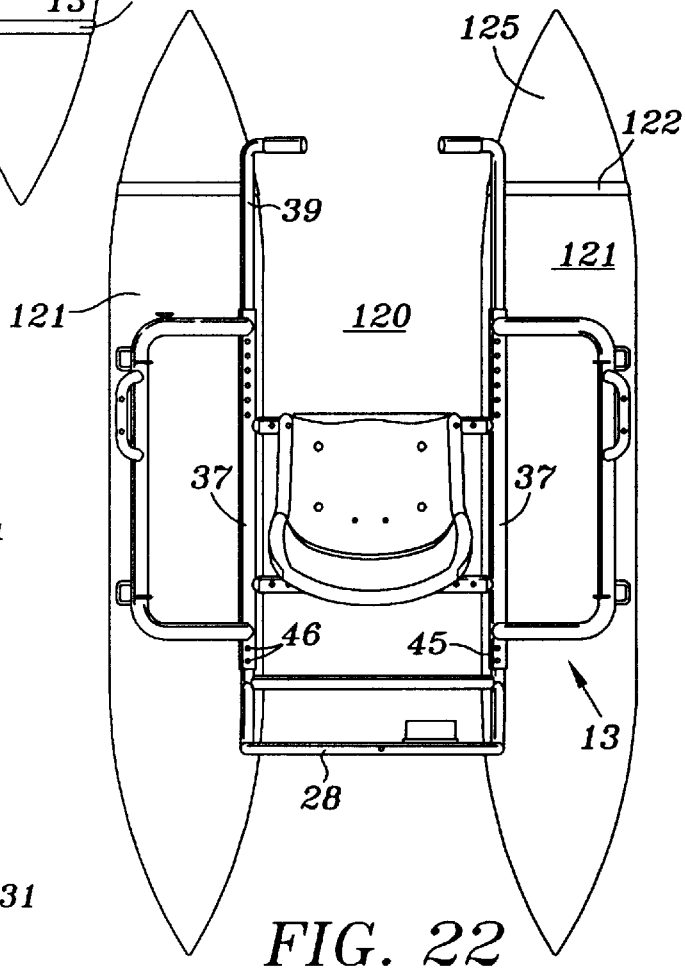
FIG. 22 is a plan view of an individual boat with the attaching devices encircling the fore ends of the pontoons.
Figure 26:
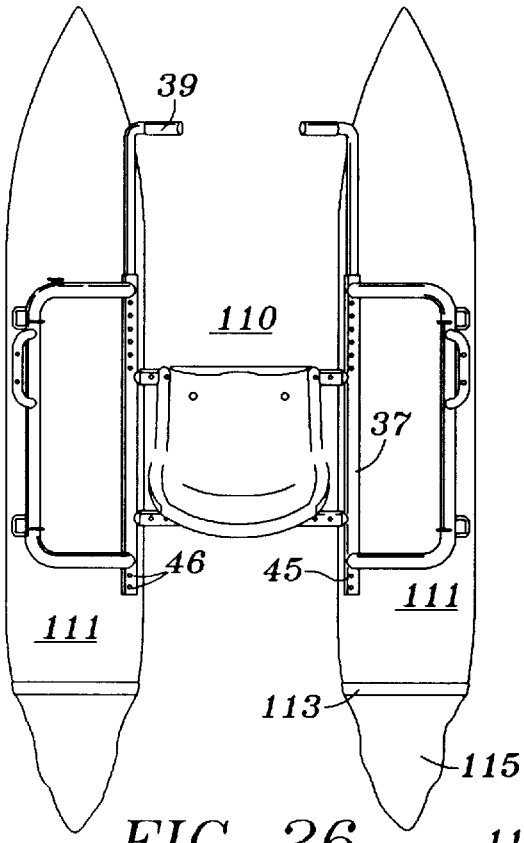
FIG. 26 is a plan view similar to FIG. 21 with the motor mounting removed and the pontoons partially deflated.
Figure 27:
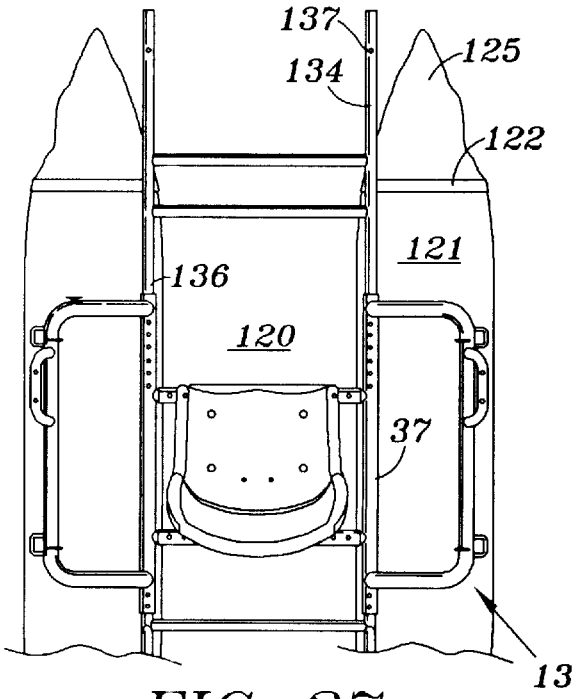
FIG. 27 is plan view similar to FIG. 22 with the foot rest removed and the lattice work in place and the pontoons slightly deflated.
Figure 28:
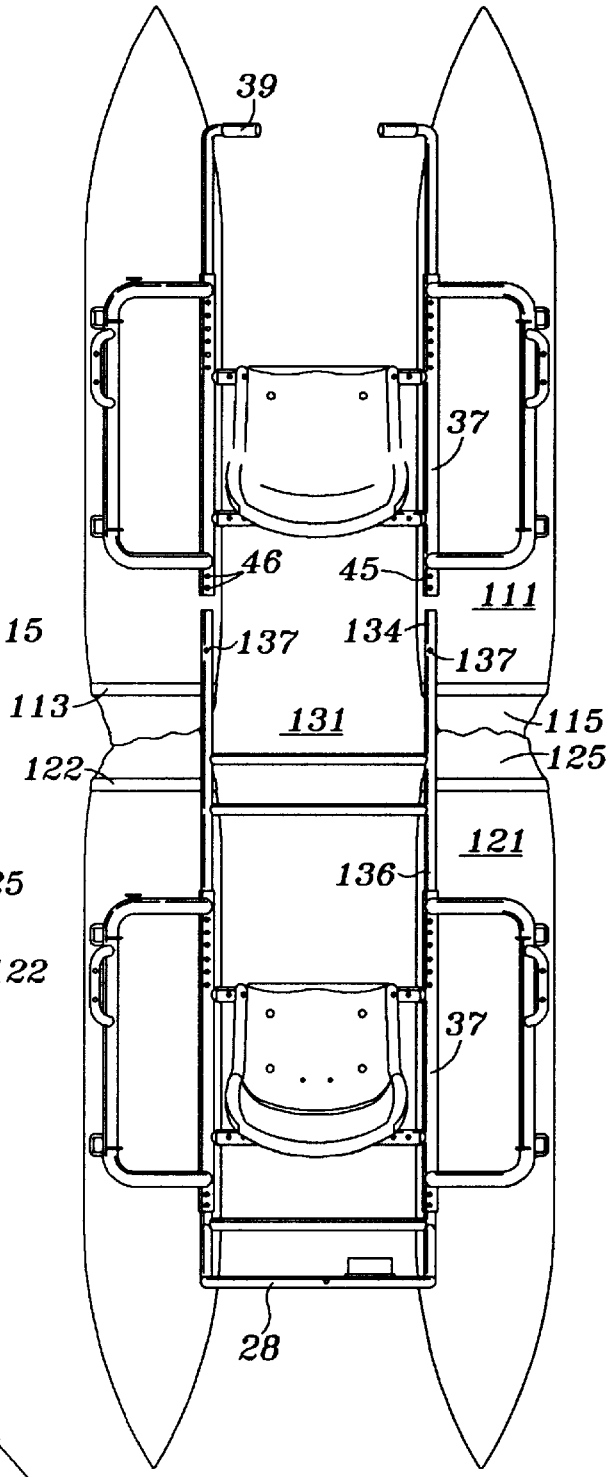
FIG. 28 illustrates the individual watercraft in FIG. 26 and the watercraft in FIG. 27 with,the aft and fore pontoons partially engaged.
Figure 29:
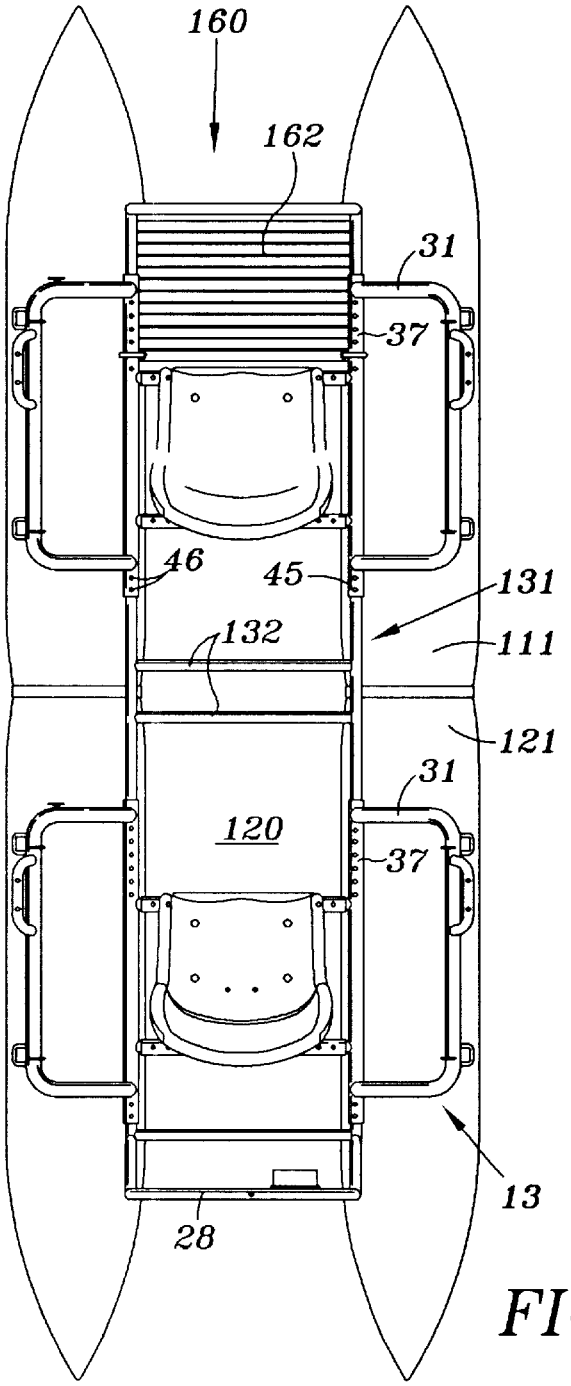
FIG. 29 illustrates the individual watercraft of FIG. 21 and the watercraft of FIG. 22 fully linked with the lattice work engaged and the pontoons nestled.
Figure 30:
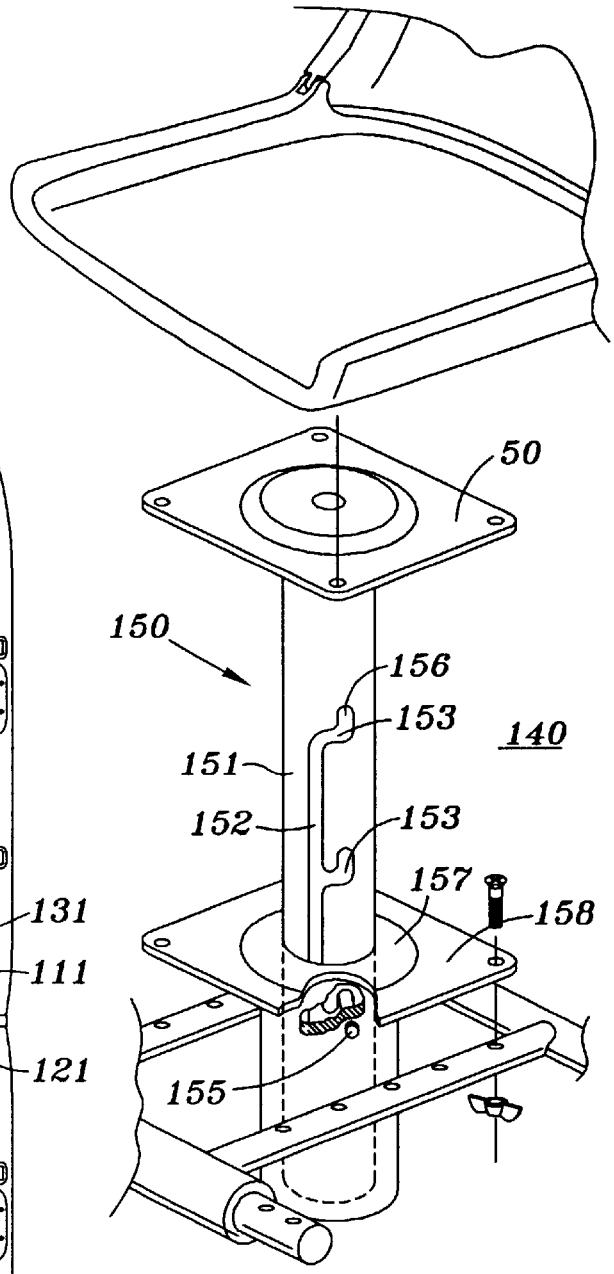
FIG. 30 is a perspective view of the adjustable pedestal with the seat removed.
Figure 31:
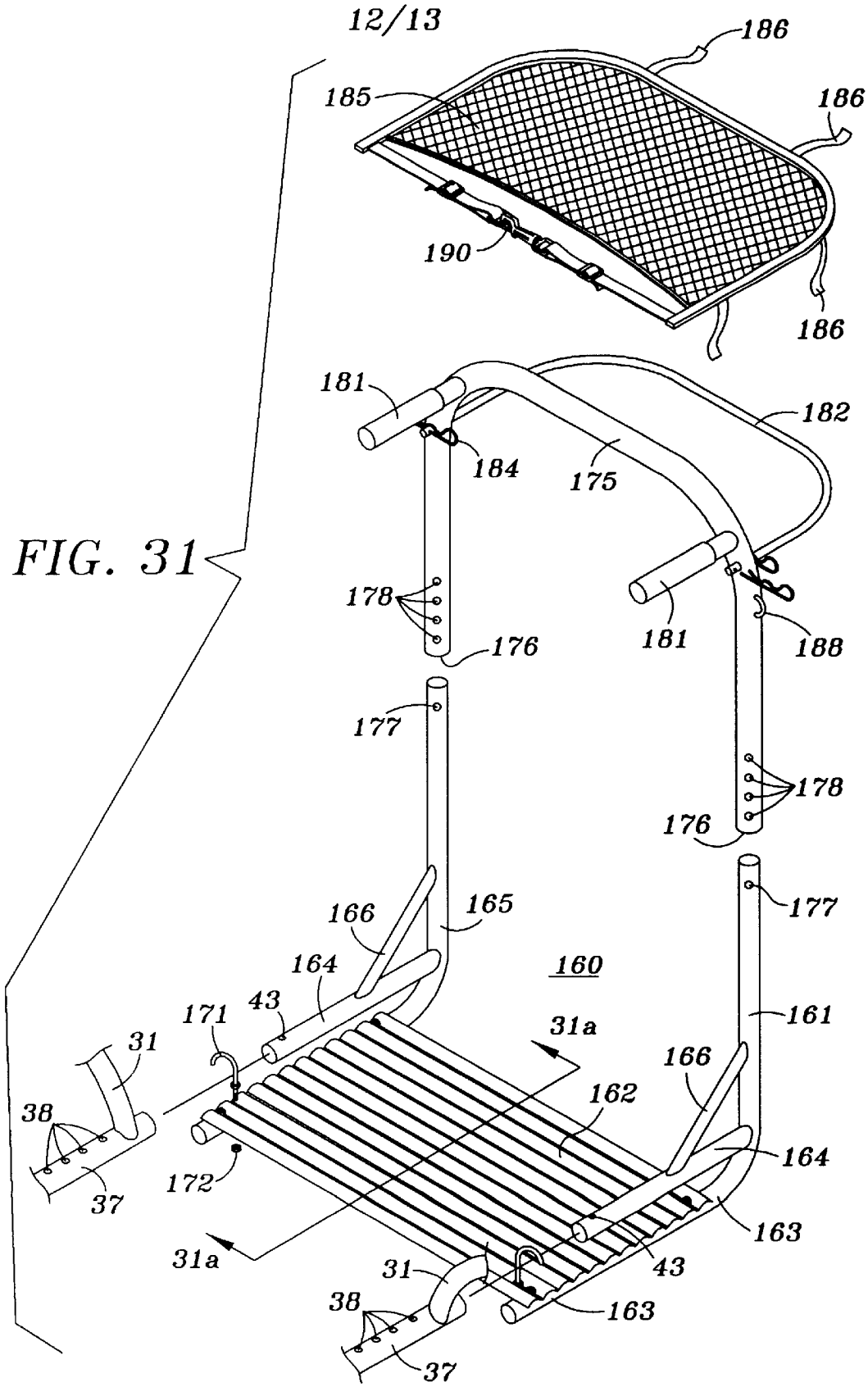
FIG. 31 is an exploded view of the standing platform and stripping apron.
Figure 31A:
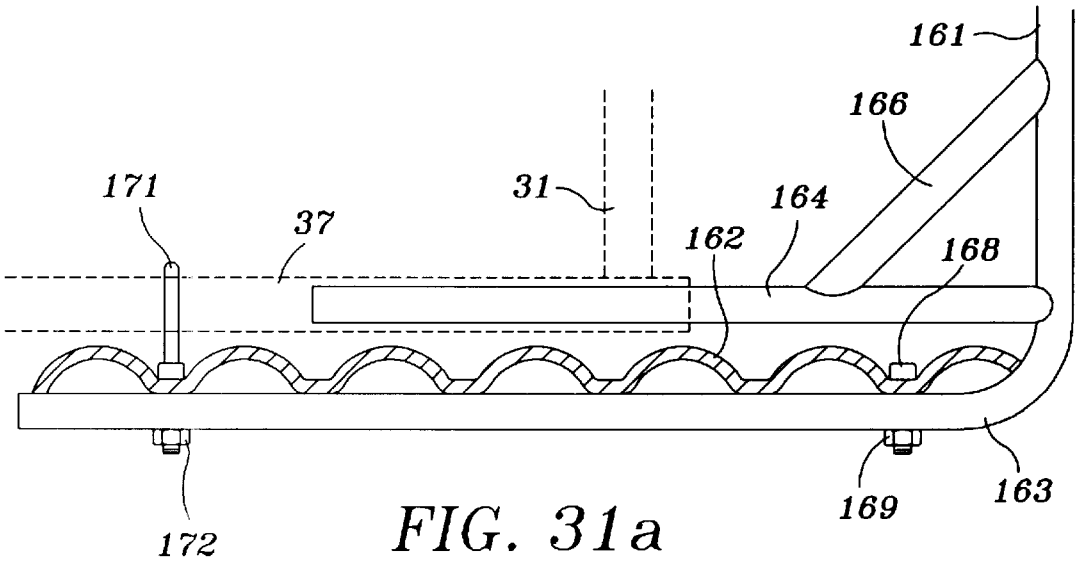
FIG. 31*a* is a detail is sectional view taken along lines 31*a*—31*a*.
Figure 31B:
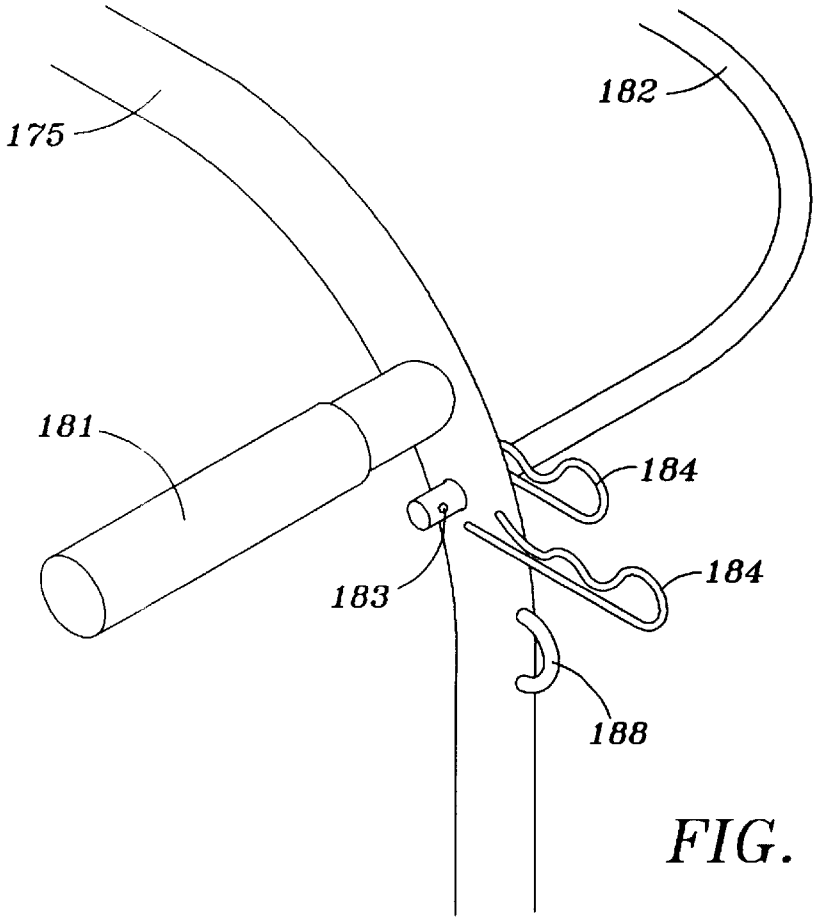
FIG. 31*b* is a detail of circular fragment 31*b* in FIG. 31.

Referring to FIG. 20, FIG. 30 and FIG. 31, pedestal seat 140 is similar to the arrangement for supporting folding seat 23 and seat swivel 48 as shown in FIGS. 18 and 19. Lower plate 50 (seen in FIG. 18 and 30) is supported and attached to pedestal post 150. Inner tubular housing 151 has longitudinal slots 152 with cross slots 153, which lock inner tubular housing 151 with pin 155 engaged in upper end 156 of slots 153 to adjust the height of seat 23. It is raised and turned until pin 155 projects in slots 152 with pin 155 oriented with longitudinal slot 152. Inner tubular housing 151 is raised and lowered in pedestal well 157 until the desired height is obtained and inner tubular housing 151 is rotated until pin 155 engages one of cross slots 153 and is lowered so that pin 155 is secured in upper end 156 of slot 153. Pedestal well 158 is attached by bolts 54 with wing nuts 65, the same as in FIG. 18.

Referring now to FIGS. 29, 31, 31*a* and 31*b*, stand-up platform or deck, generally referred to as 160, includes tubular framework 161 having mounting extension 163 and preferably forming an acute angle of approximately 80° with the deck. Tubular extensions 163 maybe slightly towed in to provide clearance between parallel arms 164, which are attached to vertical section 165 of tubular framework 161. Braces 166 are secured to parallel arms 164 and vertical section 165 to provide additional strength to parallel arms 164. Platform or deck 162 is attached to mounting extensions 163 by bolts 168 and nuts 169. At the free end of extension 163, platform 162 is secured to mounting extensions 163 by J-hook 171 secured by nut 172.

Stand-up platform 160 may be mounted to either the fore or aft end of watercraft 10 or joined watercrafts 110 and 120 and may be mounted either by removal of footrests 39 or motor mount 28. In order to attach stand-up platform 160 at the fore end of watercraft 10, footrests 39 are removed, parallel arms 164 are inserted in innermost rails 37 of yoke members 31 until snap-button locks 43 are secured in apertures 38. J-hooks 171 are loosened and rotated out of the way of yoke member 31 until parallel arms 164 are seated in innermost rails 37 after which J-hooks are rotated back and tightened down to provide additional support for platform 162 from innermost rails 37.

Likewise if it is desired to mount stand-up platform 160 at the aft end of watercraft 10 or joined watercrafts 110 and 120, motor mount 28 is removed and parallel arms 164 are inserted in innermost rails 37 of yoke members 31 until snap-button locks 43 are secured in apertures 46. In mounting stand-up platform 160, adjustments may be made by changing the positions of oar locks 40, seat mount 32 and motor mount 28 of the integrated load leveling system. The optimum load leveling can be made to accommodate a person standing on stand-up platform 160.

The upper section of stand-up platform 160 includes U-shaped tubular member 175 with open ends 176, which include a series of apertures 178 that engage snap-button locks 177 in mounting extensions 161, which permits adjustments of the height of tubular member 175 above platform 162. Tubular member 175 includes padded handle bars 181 welded or otherwise secured to tubular member 175. Support rod 182 is positioned through apertures 183 in tubular member 175 held by clips 184. Stripping apron 185 is attached to support rod 182 by ties 186. Tubular member 175 has tie down loops 188. Stripping apron 185 is secured over tubular member 175 and tied to support rod 182 and tie down loops 188. Stripping apron 185 is provided with safety belt 190. The arrangement is such that a fisher standing on the platform can position safety belt 190 around his/her midsection and hold on to handle bars 181, thus to prevent the fisher from being caught off balance from rough waters and obstructions that cause the watercraft to lurch or bounce unexpectedly.

It should be recognized that stand-up platform 160 may be mounted to the individual watercraft at either end and if desired to either or both ends of the composite watercraft. Thus the watercrafts can be suitably tailored to the desires of the individual users.

What is claimed is:

1. A pontoon watercraft adapted to be joined with a second pontoon watercraft comprising:

(a) two inflatable elongated pontoons, i. each pontoon having a pair of spaced apart straps, each strap medially affixed to the underside of the pontoon, the straps being oriented between parallel planes through the pontoon with the axis of the pontoon perpendicular to the parallel planes and ii. each pontoon having attaching member at either or both a bow end and a stern end;

(b) a yoke assembly including a port yoke and a starboard yoke;

(c) a central support with an aft end and a fore end positioned intermediate the port yoke and starboard yoke;

(d) attaching devices for securing the yoke assembly to the two inflatable pontoons by the straps such that the straps remain between the parallel planes; and (e) a lattice work alternatively attachable to the fore end or aft end of the central support.

2. The watercraft of claim 1 wherein both the port and starboard yokes have inmost rails with facing struts which releasably attach to the central support for spacing the two inflatable pontoons apart.

3. The watercraft of claim 2 wherein a port footrest and a starboard footrest are attached to the aft end or fore end of the central support opposed to the lattice work.

4. The watercraft of claim 3 wherein the central support receives a motor and anchor mount in lieu of the port footrest and starboard footrest opposed to the lattice work.

5. The watercraft of claim 2 wherein the central support has two cross members for attachment to the port and starboard yokes such that the yokes remain parallel to each other, and two spaced apart support bars for retaining the cross members parallel and mounting a seat.

6. The watercraft of claim 5 wherein a seat is mounted to the support bars.

7. The watercraft of claim 6 wherein the seat is mounted on a lockable swivel mechanism attached to the support bars.

8. The watercraft of claim 5 wherein a seat is mountable in several fore and aft positions on the support bars.

9. The watercraft of claim 1 wherein the attaching devices are loop parts mounted on the port yoke and the starboard yoke, the loop parts being oriented between the parallel planes.

10. The watercraft of claim 1 wherein the pair of spaced apart straps are compound straps, each having a long strap medially affixed to the underside of the pontoon with its ends free and a short strap medially affixed over the long strap to the underside of the pontoon with a buckle attached to each end of the short strap, such that upon assembly each free end of each long strap links with the attaching devices and fastens to one of the buckles of the short strap affixed over its corresponding long strap securing the pontoons to the yoke assembly.

11. A composite watercraft comprising:

(a) a pair of watercrafts i. each having a port pontoon and a starboard pontoon oriented axially parallel with each other, ii. each starboard pontoon and port pontoon of each of said pair of watercrafts having a pair of spaced apart straps affixed to the underside of each starboard pontoon and port pontoon, each strap oriented to exert radial forces with ends of the straps extending substantially beyond the underside forming tie downs, iii. each watercraft having a yoke assembly including a pair of yoke members spaced apart by a central support for seating over the said pair of pontoons and spanning the top surface of the pontoons and maintaining the pontoons parallel and symmetrical with each other, held in such position by the tie-downs secured to the yoke members; and (b) a lattice work engaging the aft section of the central support of one of said pair of watercrafts and engaging the fore portion of the central support of the other one of said pair of watercrafts and said lattice work, maintaining the aft end of each starboard pontoon and port pontoon of one of said pair of watercrafts mated with the fore end of each starboard pontoon and port pontoon of the other of said watercrafts, respectively.

12. The composite watercraft of claim 11 wherein either or both the central supports releasably retain a utile member opposite the lattice work comprising:

(a) the yoke assembly for securing pontoons thereto including a pair of yoke members, one seated on the top side of each pontoon and contoured thereto, and a central support attached to each yoke member spacing them apart;

(b) gunwales on each yoke member for mounting oars; and (c) a swivel mounting for attaching an adjustable height seat to the central support.

13. In a pontoon watercraft, a pair of elongated pontoons oriented axially parallel with each other, and a yoke assembly mounted upon the pontoons arranged to retain the pontoons in spaced apart, axially parallel arrangement to provide support for cargo, the improvement comprising:

(a) the yoke assembly for securing pontoons thereto including a pair of yoke members, one seated on the top side of each pontoon and contoured thereto, and a central support attached to each yoke member spacing them apart;

(b) gunwales on each yoke member for mounting oars;

(c) a swivel mounting for attaching an adjustable height seat to the central support:

(d) the inflatable pontoons having strapping material sewn to the underside of each pontoon in two places, the strapping material oriented on radii with a common center on the longitudinal axis of the pontoon, the strapping material being releasably attached to the yoke assembly with the pontoons being parallel and symmetrical to each other;

(e) the yoke assembly having a fore end and an aft end, both adapted to attach either a foot rest for independent use or a lattice work for attachment in tandem with another similarly constructed watercraft; and (f) the lattice work adapted to maintain the fore portions of one of said pair of pontoons nestled with the aft portions of another pair of pontoons of such similarly constructed watercraft.

14. In a pontoon watercraft having a pair of symmetrically parallel pontoons spaced apart by a yoke assembly, the yoke assembly adapted to releasably secure utile members in a fore and aft position; the improvement wherein a utile member comprises:

(a) a standing platform including a framework having a horizontal section and an upright section;

(b) the horizontal section supporting a deck whereupon a user stands, and releasably securing the standing platform to the yoke assembly; and (c) the upright section forming a support railing for aiding the user in maintaining balance while standing.

15. The watercraft of claim 14 where the horizontal section includes a pair of arms for releasably securing the standing platform to the yoke assembly.

16. Pontoon watercraft of claim 15 wherein the arms are stabilized by braces connected to the upright section.

17. The watercraft of claim 16 wherein the deck is also secured to the horizontal section by J-hooks that engage the yoke frame to provide additional support for the standing deck.

18. The watercraft of claim 14 wherein the upright section includes a horizontal support rod and pair of handles.

19. The watercraft of claim 18 wherein a stripping apron and safety belt are attached to the support rod by straps with the safety belt adapted to surround an individual utilizing the standing platform.

20. The watercraft of claim 14 wherein the upright section of the standing platform is tilted aft.

* * * * *